US006170793B1

(12) United States Patent
Clarke

(10) Patent No.: US 6,170,793 B1
(45) Date of Patent: Jan. 9, 2001

(54) TRACK SYSTEM FOR WALL HANGINGS

(76) Inventor: Gregory A. Clarke, 1253 Wayne Court, London, Ont. (CA), N6K 3ZY ( * ) Notice: Under 35 U.S.C. 154(b), the term of this patent shall be extended for 0 days.

(21) Appl. No.: 09/195,160

(22) Filed: Nov. 18, 1998

(51) Int. Cl.[7] ..... A47G 1/24

(52) U.S. Cl. ..... 248/476; 248/490; 248/495

(58) Field of Search ..... 248/476, 298.1, 248/490, 495, 497, 489, 493, 257, 265, 269, 259; 211/85.9, 85.3

(56) References Cited

U.S. PATENT DOCUMENTS

| | | | | |
|---|---|---|---|---|
| 956,696 | | 5/1910 | Frost | 211/85.3 |
| 1,758,292 | | 5/1930 | Meyer et al. | 248/298.1 |
| 1,844,096 | | 2/1932 | Levene | 248/307 |
| 2,469,923 | | 5/1949 | Jones | 248/476 |
| 2,976,005 | | 3/1961 | Stell | 248/298.1 |
| 3,729,627 | | 4/1973 | Littell | 362/131 |
| 3,838,842 | | 10/1974 | McCracken | 248/476 |
| 3,945,599 | * | 3/1976 | Spier et al. | 248/476 |
| 4,611,779 | | 9/1986 | Leonard, Jr. | 248/476 |
| 4,678,151 | | 7/1987 | Radek | 248/223.41 |
| 4,771,897 | | 9/1988 | Ho | 211/85.9 |
| 4,775,127 | | 10/1988 | Nakamura | 248/489 |
| 4,892,284 | | 1/1990 | Kelrick | 248/476 |
| 4,973,021 | * | 11/1990 | Schuite | 248/495 |
| 5,342,014 | | 8/1994 | Wilson | 248/476 |
| 5,992,813 | * | 11/1999 | Keers | 248/489 |
| 6,003,825 | * | 12/1999 | Abernathy, Jr. | 248/478 |

OTHER PUBLICATIONS

Martha Stewart, "Decorating Details", 1998, pp. 16–17 (cover and inside front cover pages also enclosed).

* cited by examiner

*Primary Examiner*—Anita M. King
(74) *Attorney, Agent, or Firm*—Bereskin & Parr

(57) ABSTRACT

A track system for suspending a wall hanging on a wall surface comprises a track, a plurality of longitudinally spaced connectors, and at least one carriage having a suspending device. Each connector consists of a threaded sleeve, a pair of nuts, a washer, a wood screw and a center point guide to protect the wall surface. Each threaded sleeve is dimensioned to fit within a corresponding aperture in the back wall of the track and to receive a pair of nuts on its threaded outer surface. The nuts are positioned on the threaded sleeve on either side of the track's back wall so that the back wall is securely gripped between the nuts. The lateral offset distance between the back wall of the track and the wall surface can be adjusted by changing the relative position of the nuts on the threaded sleeve so as to compensate for any irregularities in the wall surface. The carriage has a carriage body adapted to slidably engage the track along its length and a clamp for releasably locking the carriage body against the track depending on whether lateral pressure is applied to the finger grip. The carriage's suspending device is attached to the bottom of the carriage body and comprises a hook and a hook position adjuster. The position adjuster comprises a guide block, a hook bracket, an adjusting screw and a casing. The casing is dimensioned to receive the guide block, the hook, the hook bracket and the adjusting screw. The hook is positioned within casing such that when adjustable screw is turned, the hook can be laterally positioned towards or away from the wall surface.

21 Claims, 9 Drawing Sheets

TRACK SYSTEM FOR WALL HANGINGS

FIELD OF THE INVENTION

This invention relates to apparatus for mounting artwork and the like on interior walls, and more particularly, to a track system for wall hangings which facilitates the rearrangement thereof.

BACKGROUND OF THE INVENTION

Paintings, prints, pictures, and other wall hangings are typically mounted on residential and commercial wall surfaces by a hook or other securing device which penetrates the wall surface. To reposition the wall hanging at some other location on the wall surface, it is necessary to remove and reposition the securing device. The removal of hooks or nails from the wall causes damage to the wall surface and creates unsightly holes which must be filled and refinished or hidden from view by another wall hanging. Also, if the wall structure is not strong enough to support heavier wall hangings, it is necessary to attach the securing device to the upright studs within the wall. This restricts the horizontal placement of the wall hanging to the vicinity of a wall stud.

Track systems have been developed to allow a user to position a wall hanging in a variety of locations on a wall surface without the need for individual hooks or nails. For example, U.S. Pat. No. 5,342,014 to Wilson, describes a display system for artwork which uses a moulding bracket attached to the top of a wall and a plurality of vertical display units attached to and slidable along the moulding bracket.

However, this prior art display system does not facilitate convenient horizontal movement of the vertical display units. A user must first loosen the screws that couple the vertical bar with the horizontal bar before the vertical bar can be moved horizontally within the horizontal bar. This display system also fails to compensate for an uneven wall, since the horizontal track is mounted directly onto the wall. This could result in the horizontal track being crooked when mounted. Further, since wall hangings are to be mounted on the vertical display units using a mounting brace secured at the back of the picture, regular wall hangings having wire attachments cannot be accommodated by the display system.

There is accordingly a need for a track system which allows wall hangings to be suspended evenly on an irregular wall surface, and easily repositioned at various positions on a wall without damaging the wall surface. There is also a need for a track system which can be used in association with conventionally wire hung wall hangings.

SUMMARY OF THE INVENTION

The present invention is directed to a track system for adjustably suspending wall hangings on a wall having an uneven wall surface, comprising an elongated track, a plurality of longitudinally spaced connectors and at least one carriage. The track is dimensioned to extend horizontally along the wall. Each connector extends between the track and the wall for rigidly coupling the track to the wall and aligning the track in a straight horizontal line laterally offset from the wall surface. Each of the connectors is individually adjustable in length so as to compensate for local irregularities in the wall surface. Each carriage is shaped for engaging and sliding along the track and has a suspending device for suspending a wall hanging.

The present invention is also directed to a track system for adjustably mounting wall hangings on a wall comprising an elongated track, a plurality of longitudinally spaced connectors, and at least one carriage. The elongated track is dimensioned to extend horizontally along the wall. Each connector extends between the track and the wall for rigidly mounting the track on the wall. Each carriage is shaped for sliding along the track and has a generally C-shaped carriage body, a releasable clamp and a suspending device. The carriage body is shaped to slidingly engage the track and has a finger grip on its front surface for sliding the carriage along the track. The releasable clamp releasably secures the carriage body on the track, the clamp being released when pressure is applied to the finger grip. The suspending device is attached to the carriage body and comprises a hook shaped to suspend a wire extending upwardly from a wall hanging.

The present invention is also directed to a track system for adjustably mounting wall hangings on a wall, comprising an elongated track, a plurality of longitudinally spaced connectors, and at least one carriage. The elongated track is dimensioned to extend horizontally along the wall. Each connector extends between the track and the wall for rigidly mounting the track on the wall. Each carriage is shaped for sliding along the track and has a generally C-shaped carriage body shaped to slidingly engage the track and a suspending device. The suspending device depends from the carriage body for suspending a wall hanging, and comprises a hook and a hook adjuster for adjusting the lateral position of the hook relative to the wall surface.

BRIEF DESCRIPTION OF THE DRAWINGS

The invention will now be described, by way of example only, with reference to the following drawings, in which.

DETAILED DESCRIPTION OF THE PREFERRED EMBODIMENT

Figure 1:
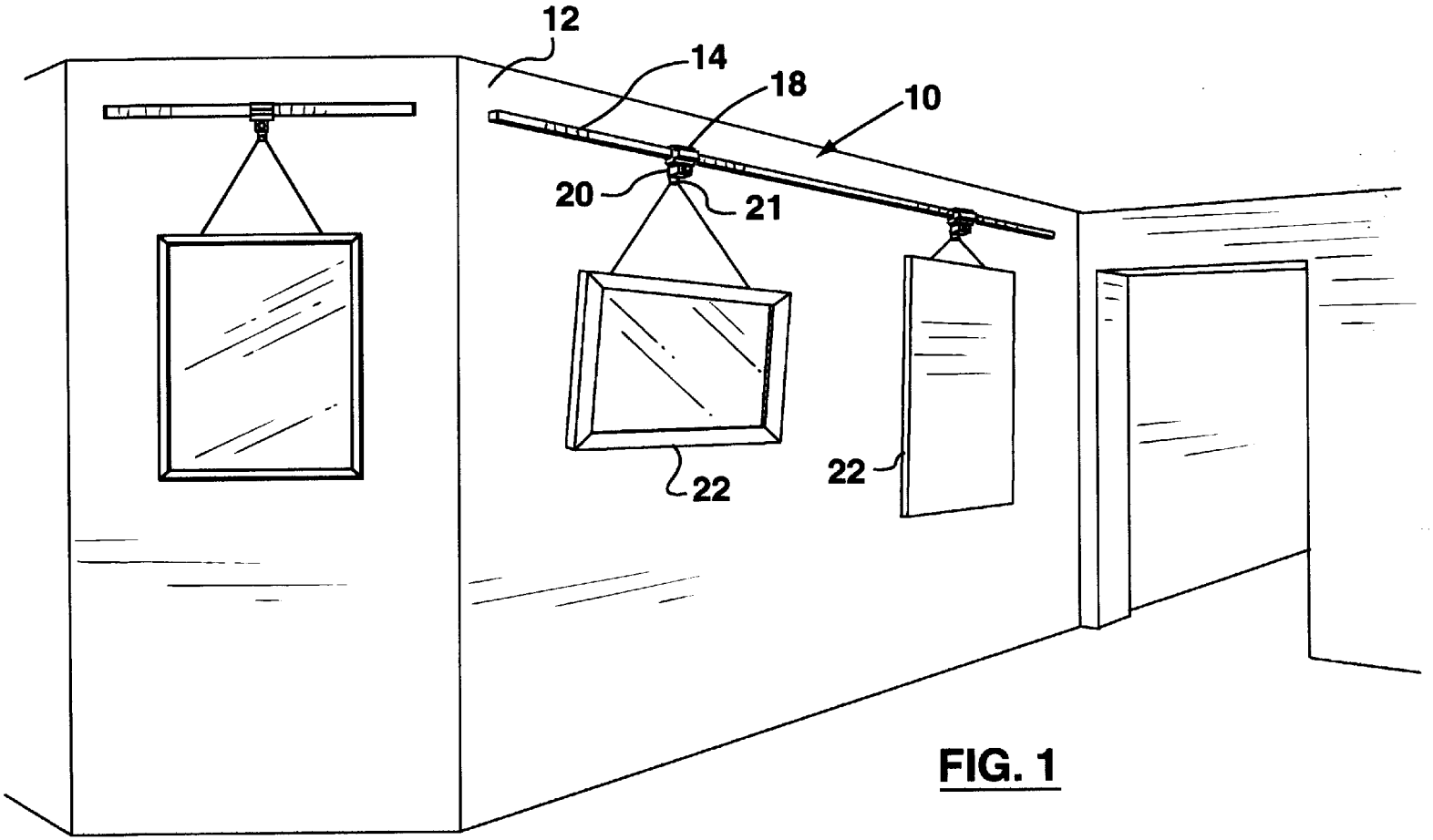
FIG. 1 is a diagrammatic perspective view of the track system mounted on a wall and made in accordance with the present invention.

Referring to FIG. 1, illustrated therein is a track system 10 made in accordance with a preferred embodiment of the present invention. Track system 10 comprises an elongated track 14, track-to-wall connectors (not shown) and carriages 18. Track system 10 is designed to mount a number of wall hangings 22 at various positions on a wall 12.

Track 14 extends horizontally along wall 12, and is rigidly attached to wall 12 by connectors at spaced intervals along the length of track 14. Track 14 is preferably secured about six to fourteen inches below the ceiling on wall 12 to suspend wall hangings 22 at a wide variety of positions on wall 12. Track 14 is preferably constructed from aluminum, although other suitable materials may be used.

Each carriage 18 is shaped to slidably engage track 14 and to slide along the length of track 14. Carriage 18 includes a suspending device 20 having a hook 21 shaped to engage a wire or other attachment element attached to wall hanging 22.

Figure 2:
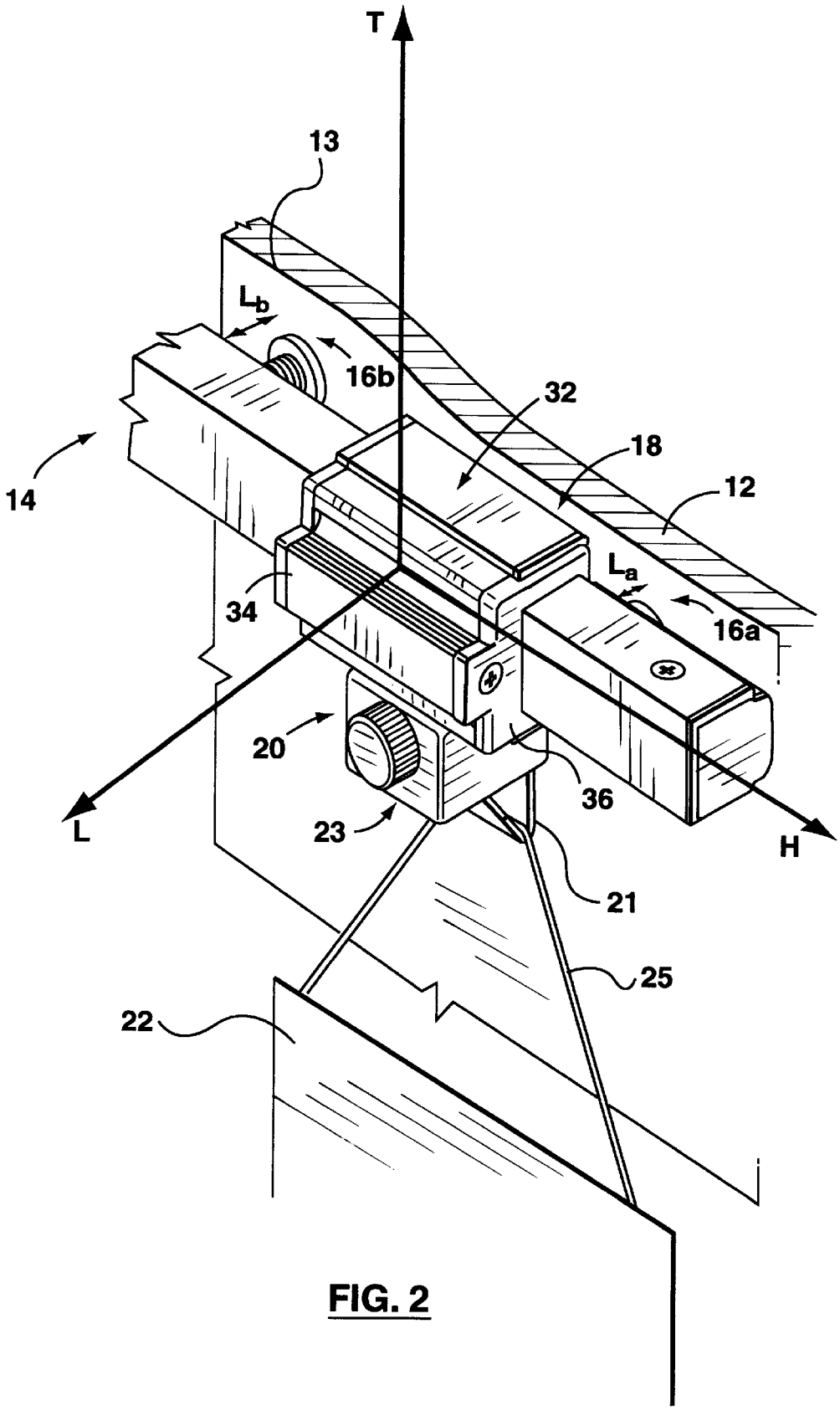
FIG. 2 is a detailed perspective view of a section of the preferred embodiment of the present invention.

FIG. 2 is a perspective view of an end section of track 14 attached to wall 12 by two connectors 16*a* and 16*b*. As shown connectors 16*a* and 16*b* rigidly attach track 14, in a generally horizontal manner, to wall 12. The lateral axis (L) is defined as being perpendicular to the conventionally understood horizontal (H) axis and the transverse (T) axis as indicated by the solid arrows L, H, and T.

Each connector 16*a* and 16*b* attaches a section of track 14 at a lateral distance from wall 12 corresponding to the length of the connector 16*a* and 16*b*, namely $L_a$ and $L_b$, respectively. Wall surface 13 is uneven in the vicinity of connectors 16*a* and 16*b*. In order to compensate for the unevenness of wall surface 13, connector 16*a* is adjusted to have a relatively short length $L_a$ and connector 16*b* is adjusted to have a relatively long length $L_b$. More generally, by adjusting the length of each individual connector 16 along the length of track 14, the entire extent of track 14 can be maintained in a straight horizontal line in spite of an irregular wall surface 13.

Carriage 18 is shaped and dimensioned to be slidably engaged on track 14 so that carriage 18 can slide along the length of track 14, past connectors 16 (such as 16*a* and 16*b*). Carriage 18 preferably comprises carriage body 32 shaped for slidably engaging track 14, a finger grip 34 and end caps 36. Carriage body 32 securably engages track 14 to prevent accidental disengagement while system 10 is in use.

Suspending device 20 is attached to the bottom of carriage 18 and comprises a hook position adjuster 23 coupled to the bottom of carriage body 32 having hook 21 depending therefrom shaped to receive a wire 25 extending upwardly from wall hanging 22.

Figure 3:
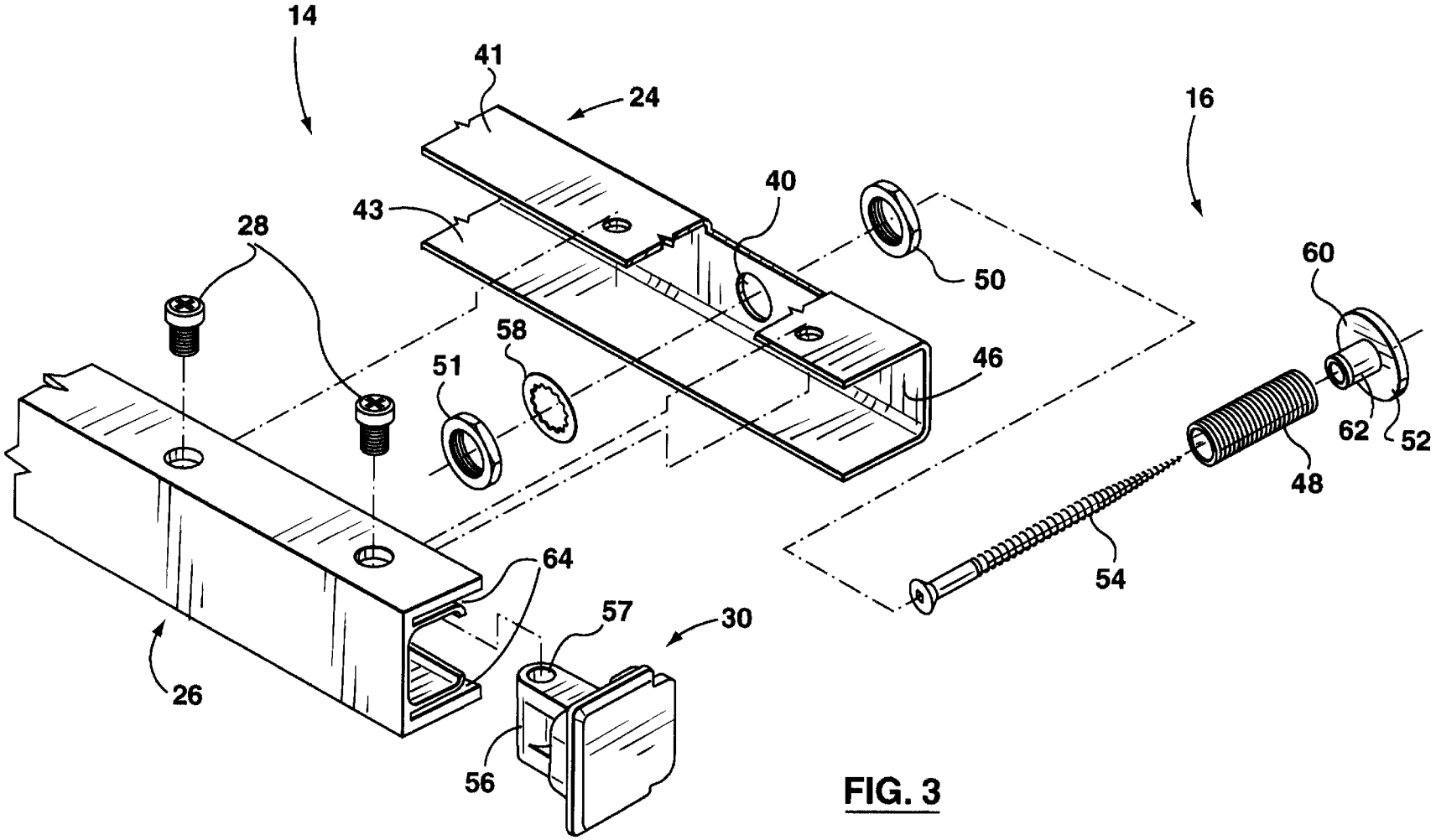
FIG. 3 is an exploded perspective view of the track and a connector of the preferred embodiment of the present invention.

FIG. 3 shows one end of track 14 and connector 16 which is adapted to engage the end section of track 14. Track 14 preferably comprises track beam 24, and track cover 26 having end caps 30.

Track beam 24 comprises top flange 41, bottom flange 43 and back wall or web 46 which contains a plurality of apertures 40 which are sized to receive threaded sleeves 48. Track beam 24 is preferably composed of extruded aluminum, although it could be formed from an elongated aluminum or steel sheet which can be bent into the desired shape. Track cover 26 includes cover slots 64 for receiving flanges 41, 43 of track beam 24. Track end cap 30 is also provided with an extension 56 having an aperture 57 sized to receive screw 28 when track cover 26 is engaged with track beam 24. Track end cap 30 is shaped to snap into the end of track cover 26. Track cover 26 is further secured to track beam 24 by screws 28.

Connector 16 preferably comprises threaded sleeve 48, center point guide 52, a wood screw 54, nuts 50 and 51, and a washer 58. Threaded sleeve 48 is sized to fit within aperture 40 of web 46 of track beam 24, with nut 50 positioned on one side of web 46 and nut 51 and washer 58 positioned on the other side of web 46. Wood screw 54 is dimensioned to fit within threaded sleeve 48 so that the threaded end extends past threaded sleeve 48 and through center point guide 52 for engagement with wall 12.

Center point guide 52 comprises a footing 60 and a sleeve 62. Footing 60 is positioned between threaded sleeve 48 and wall surface 13 and is used to distribute pressure borne by track system 10 along its surface to minimize damage to wall surface 13. Sleeve 62 is used to reduce the diameter of the bore within the threaded sleeve 48 to centre wood screw 54 within threaded sleeve 48 for ease of installation.

Connector 16 is attached to the wall by first inserting center point guide 52 into one end of threaded sleeve 48 and inserting wood screw 54 into the other end, such that the threaded end of wood screw 54 extends past threaded sleeve 48 for engaging wall 12. The resulting assembly is then fastened to wall 12 by wood screw 54 such that center point guide 52 is secured flush against wall surface 13. Nuts 50 are then engaged onto threaded sleeves 48 and aligned to support a straight edge or string line. Track beam 24 is positioned on threaded sleeves 48, and nuts 51 are engaged onto threaded sleeves 48, so that track beam 24 is gripped in between nut pairs 50 and 51 on threaded sleeves 48.

Figure 4:
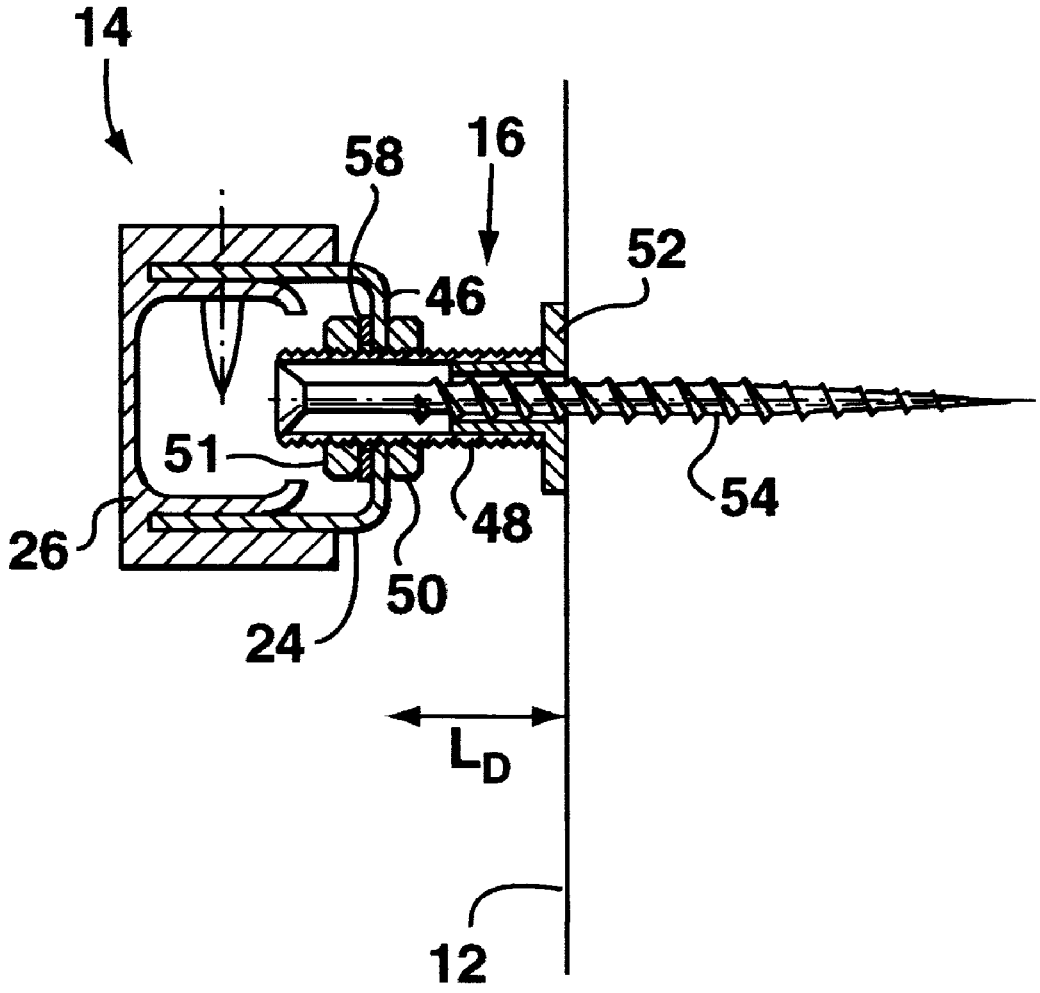
FIG. 4 is a side cross-sectional view of the track engaged to the wall using a connector according to the present invention.

FIG. 4 is a side cross-sectional view of track 14 when it is coupled by connector 16 to wall 12. Wood screw 54 is positioned within threaded sleeve 48 and center point guide 52. The head of wood screw 54 is securely engaged with the free end of threaded sleeve 48 and the threaded end of wood screw 54 is engaged with wall 12 through center point guide 52. In this way threaded sleeve 48 is securely attached to wall 12.

Nuts 50 and 51 and washer 58 are engaged on the outer surface of threaded sleeve 48. Web 46 of track 14 is gripped between nuts 50 and 51 of connector 16. As a result, web 46 is laterally offset from wall surface 13 by distance $L_D$ and track 14 is securely attached by connector 16 to wall 12.

Figure 5:
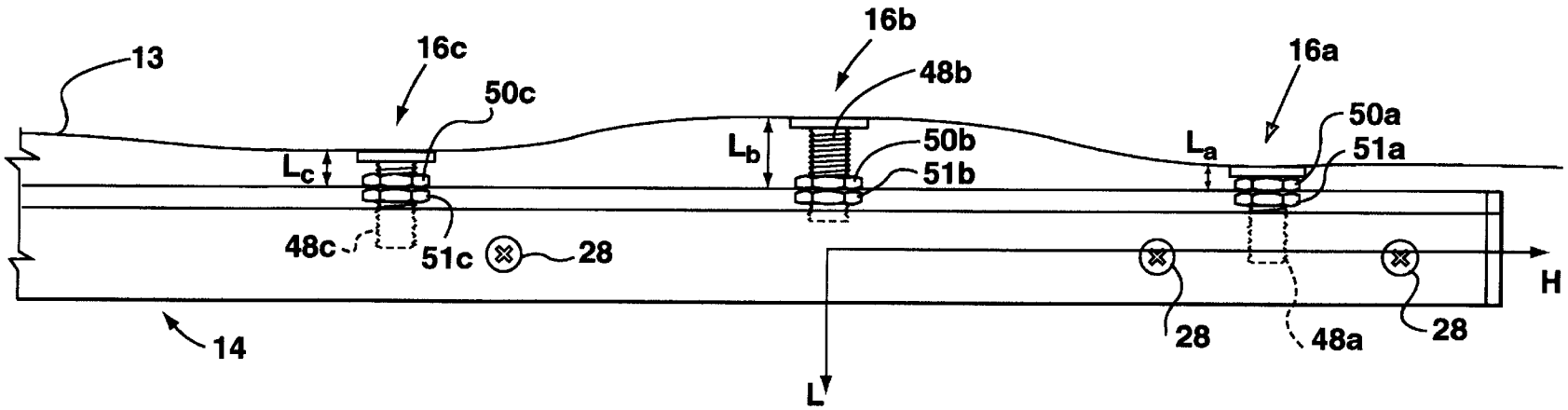
FIG. 5 is a top view of the track and three connectors of the preferred embodiment of the present invention.

FIG. 5 illustrates how three connectors 16*a*, 16*b* and 16*c* are used to couple a web 46 of one end of track 14 to wall 12 to maintain track 14 in a straight horizontal line. Wall 12 is shown having an uneven wall surface 13 with lateral irregularities.

Each connector 16*a*, 16*b*, and 16*c* can be used to offset track 14 from wall surface 13 laterally by adjusting the nuts 50*a* and 51*a*, 50*b* and 51*b*, and 50*c* and 51*c* on threaded sleeves 48*a*, 48*b*, and 48*c*, respectively. Accordingly, the unevenness of wall surface 13 can be compensated for by adjusting nuts 50*a* and 51*a* of connector 16*a* so that track 14 is laterally offset from wall surface 13 by $L_a$, adjusting nuts 50*b* and 51*b* of connector 16*b* so that track 14 is laterally offset from wall surface 13 by $L_b$, and adjusting nuts 50*c* and 51*c* of connector 16*b* so that track 14 is laterally offset from wall surface 13 by $L_c$.

Figure 6:
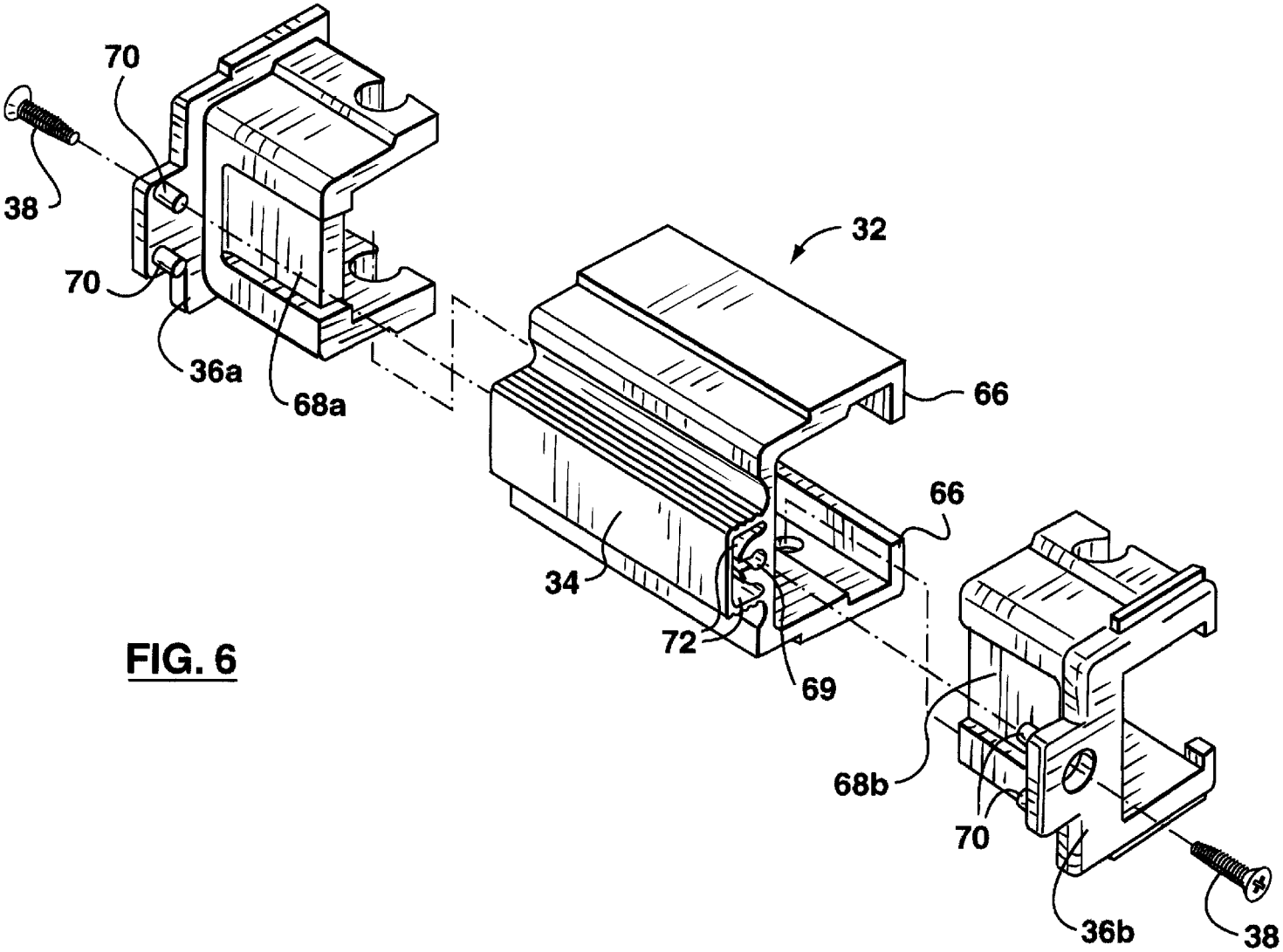
FIG. 6 is an exploded perspective view of the carriage body of the carriage of the preferred embodiment of the present invention.

FIG. 6 shows carriage body 32 having apertures 69 which are suited to receive screws 38 for securing end caps 36*a* and 36*b* to carriage body 32. Carriage body 32 further contains apertures 72 to receive end cap pins 70 when end caps 36*a* and 36*b* are attached to carriage body 32. Finger grip 34 is preferably formed in the front surface of extruded aluminum carriage body 32, although it could be made of flexible rubber for ease of manipulation.

Carriage end caps 36*a*, 36*b* have biasing arms 68*a*, 68*b* which deflect when mounting carriage 18 onto track 14. Once mounted, end caps 36*a*, 36*b*, clamp carriage body 32 onto track 14 by applying a central force to evenly force clamping legs 66 forward against track 14. In order to move carriage 18 along track 14, it is necessary to exert lateral pressure towards wall 12 on finger grip 34 to release clamping legs 66 from track 14. Carriage 18 may then be slid to the desired location and finger grip 34 released to allow biasing arms 68*a*, 68*b* to again clamp track 14. End caps 36*a* and 36*b* minimize direct contact between head 18 and track 14. This helps to eliminate marking and friction wear to these surfaces.

Figure 7:
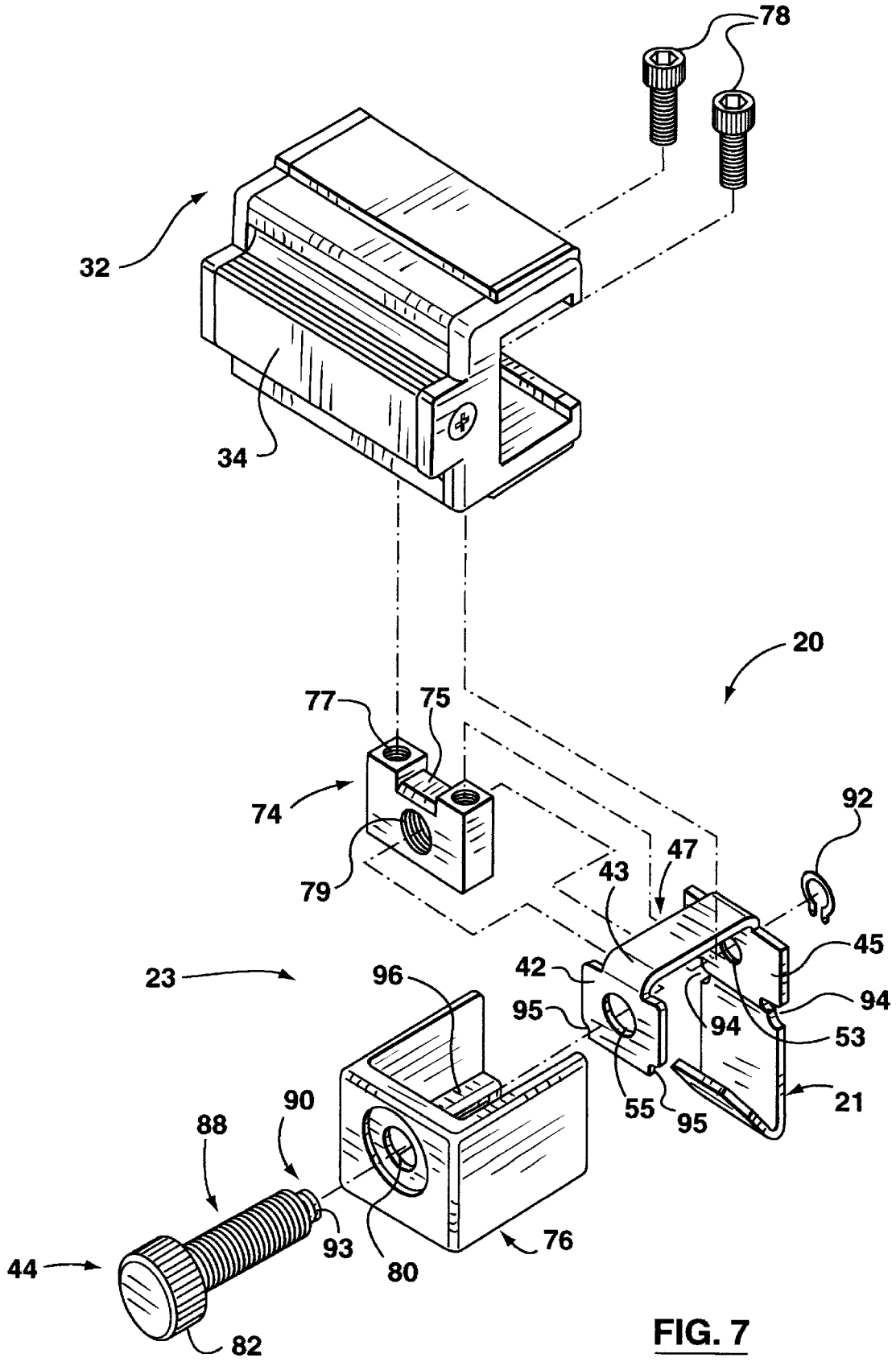
FIG. 7 is an exploded perspective view of the carriage body and the suspending device of the carriage of the preferred embodiment of the present invention.

Referring now to FIG. 7, suspending device 20 of carriage 18 preferably comprises hook 21 and hook position adjuster 23. Hook 21 is shaped to engage a wire or other attachment element attached to wall hanging 22. Hook 21 is preferably manufactured out of a durable material such as a metal alloy which is adapted to withstand the weight of a conventional wall hanging 22 and which will not suffer critically from fatigue.

Hook position adjuster 23 comprises a guide block 74, rigidly coupled to the underside of carriage body 32, hook bracket 47 which extends upwardly from hook 21, casing 76 sized to accommodate guide block 74 and hook bracket 47, and adjusting screw 44.

Guide block 74 is a generally rectangular solid block having a lateral guide slot 75 in its top surface. On either side of guide slot 75 are threaded apertures 77 for receiving screws 78 which rigidly couple guide block 74 to the underside of carriage body 32. Guide slot 75 is dimensioned to slidably receive hook bracket 47. Guide block 74 also contains a threaded lateral aperture 79 that runs through the centre of its body and which is dimensioned to engagably receive adjusting screw 44.

Hook bracket 47 extends upwardly from hook 21, and comprises a laterally extending top portion 43, a front plate 42 depending downwardly from and perpendicular to top portion 43, and a back plate 45 which is spaced from and parallel to front plate 42. Front plate 42 has an aperture 55 dimensioned to slidably receive adjusting screw 44. Back plate 45 has an aperture 53 which is smaller than aperture 55. The bottom surface of back plate 45 and the top surface of hook 21 contain indentations such that when plate 45 and hook 21 are joined together notches 94 are formed. Bottom surface of front plate 42 also contains notches 95 which are vertically aligned with notches 94.

Adjusting screw 44 has a large head 82 for ease of manipulation by the user, a uniform threaded central section 88 which fits through aperture 80 in casing 76 and which mates with threaded aperture 79 of guide block 74, and an end section 90 of reduced diameter. Aperture 53 of back plate 45 is dimensioned to receive end section 90 of adjusting screw 44 such that when adjusting screw 44 is positioned within hook bracket 47, end section 90 of adjusting screw 44 extends through back plate 45. End section 90 of screw 44 is also provided with a circular groove 93 for receiving retaining ring 92. Once end portion extends through back section 45 of hook 21, retaining ring 92 is snapped into grove 93 so as to retain end section 44 in back plate 45 as hook 21 is laterally adjusted towards and away from wall surface 13.

Casing 76 is dimensioned to cover guide block 74 and hook bracket 47 and further comprises alignment ledges 96 on its bottom side. Ledges 96 are spaced apart from each other and dimensioned to accommodate notches 94 and 95 such that hook 21 and hook bracket 47 can be laterally moved within casing 76.

When lateral top portion 43 of hook bracket 47 is engaged within guide slot 75 of guide block 74 and covered by casing 76, hook 21 extends below casing 76 to engage wall hanging 22. Once carriage 18 is positioned at the desired position on track 14, adjusting screw 44 can be used to move hook 21 towards or away from wall surface 13 as desired.

Figure 8:
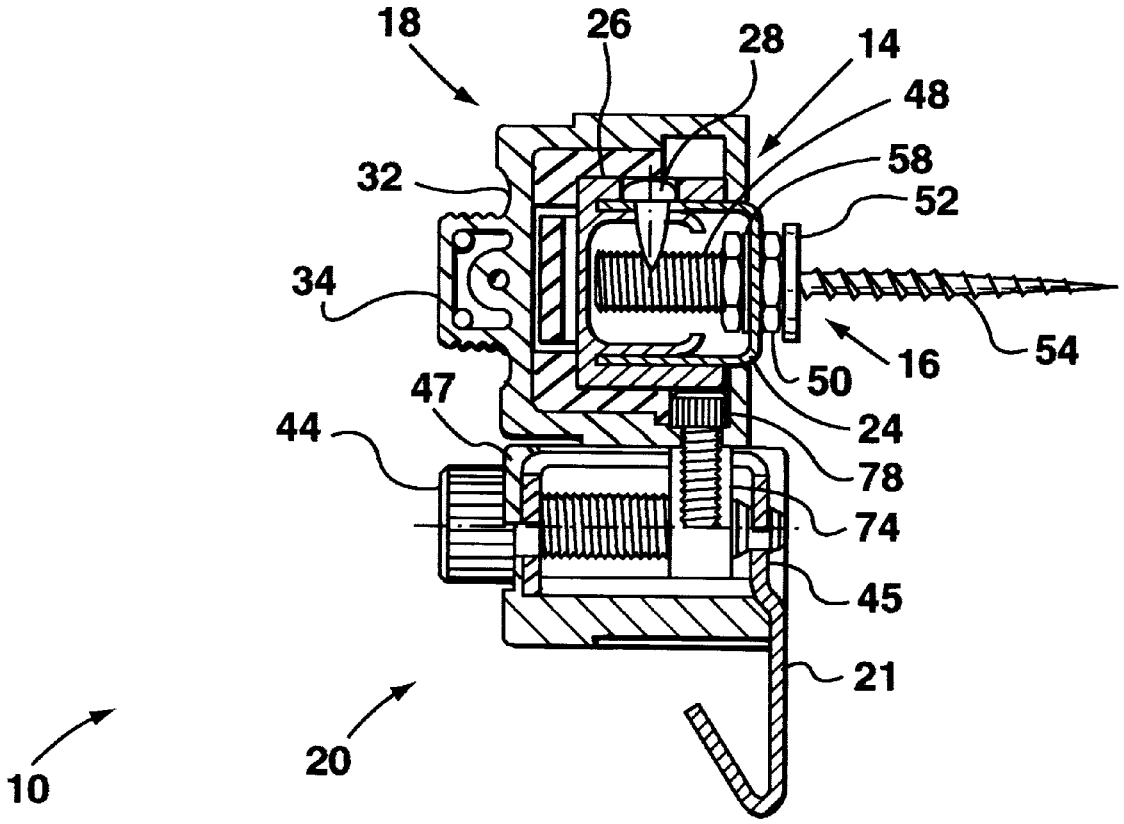
FIG. 8 is a side cross-sectional view of the track system according to the present invention.

FIG. 8 shows a side sectional view of track system 10 including track 14, connector 16, carriage 18 and suspending device 20. Since each part has already been described in detail above, the interrelationship of all the parts of track system 10 will be summarily discussed.

Wood screw 54 of connector 16 is shown engaged with wall 12 such that threaded sleeve 48 is positioned normal to wall 12 against center point guide 52. Secured threaded sleeve 48 is shown positioned within an aperture of track beam 24 such that web 46 of track 14 is gripped between nut 50 and washer 58 and nut 51, whereby track beam 24 is rigidly attached to wall 12. Track cover 26 is shown attached to track beam 24 using screws 28. Carriage 18 is shown engaged with track 14 having finger grip 34. Suspending device 20 is attached to carriage 18 using screws 78 that rigidly couple guide block 74 to the underside of carriage 18.

Figure 9:
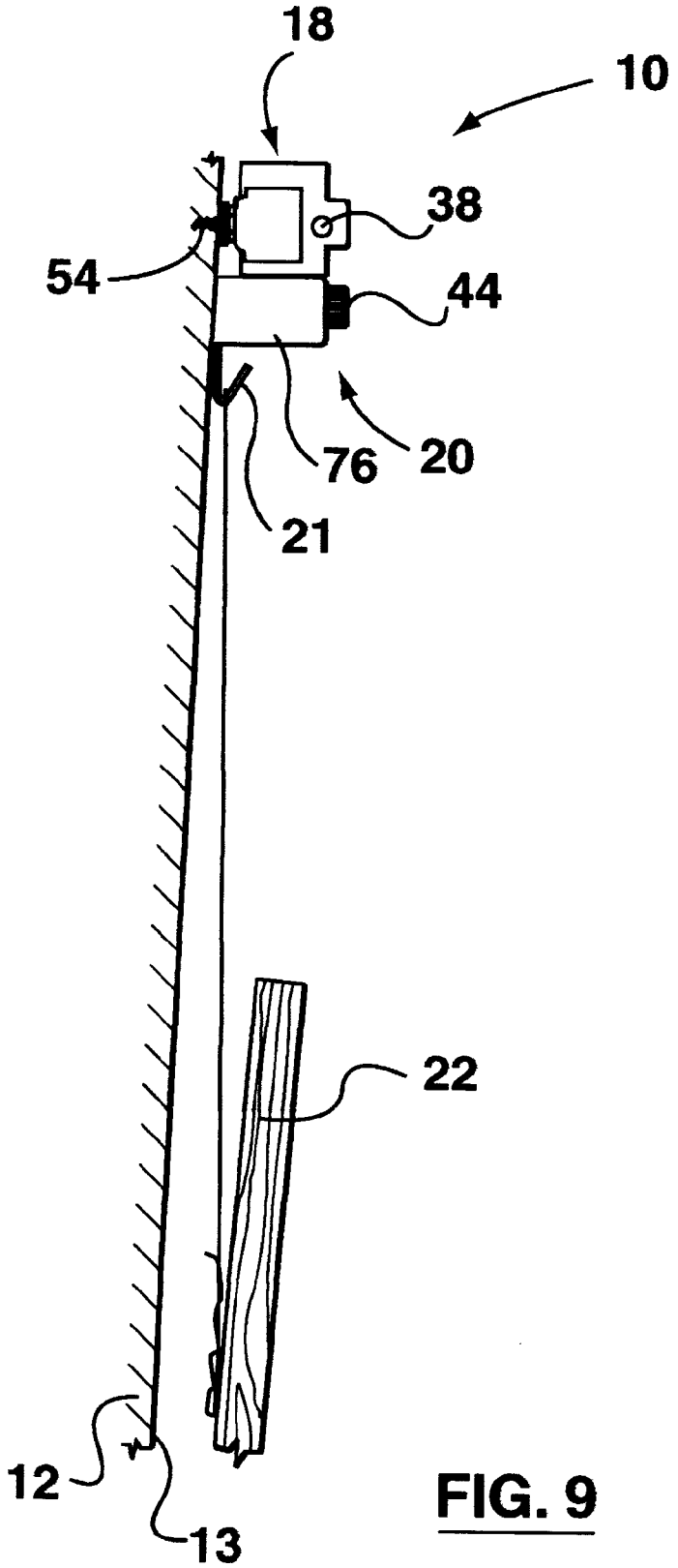
FIG. 9 is a side view of the track system in use with a typical wall hanging according to the present invention.

FIG. 9 shows a side view of track system 10 installed on wall 12 in use with wall hanging 22. Suspending device 20 is shown adjusted so as to position hook 21 flush against wall surface 13. By positioning back plate 45 in such a manner, wall hanging 22 can be hung on wall surface 13 as it would from a conventional hook or nail mounted on wall 12, even if the track is laterally offset from the wall surface because of a local surface irregularity.

In use, track beam 24 is preferably mounted on wall 12 at least six inches below the ceiling line such that approximately four inches are left between each end of track 14 and another wall or obstruction. A minimum of six inches of space is required to conveniently assemble track cover 26 onto track beam 24 with screws 28 using a conventional screw driver. Positioning track system 10 approximately 6–14 inches from the ceiling line provides a sleek architectural look similar to a conventional molding, and also eliminates any visual guide that might be made between a straight track 14 and an uneven ceiling surface. To accomplish mounting of track 14, track beam 24 is first positioned on wall 12 in order to determine placement of wood screws 54 and initial marking holes are made on wall surface 13 while track beam 24 is held in place manually.

Track beam 24 is then removed from wall surface 13 and threaded sleeves 48 are coupled to center point guides 52 both fastened to wall 12, such that center point guides 52 are placed flush against wall surface 13 at the marked positions, using wood screws 54. Nuts 50 are then placed on threaded sleeves 48 and track beam 24 is positioned on threaded sleeves 48 against nuts 50. Finally, nuts 51 and washer 58 are installed on threaded sleeves 48, so that track beam 24 is gripped in between nut pairs 50 and 51 on threaded sleeve 48.

Track cover 26 is then attached over track beam 24 and screws 28 are used to secure track cover 26 over track beam 24. Suspending device 20 is attached to the bottom of carriage body 32 using screws 78. Carriage 18 is then installed onto track 14 so that it may slide along the length of track 14. Once carriage 18 is positioned at the desired location on track 14, adjusting screw 44 is adjusted to position hook 21 laterally relative to wall surface 13.

Should the user desire to repaint or otherwise decorate wall surface 13, track 14 can be removed and reinstalled without having to readjust connectors 16. Removal is accomplished by removing screws 28, end caps 30 and front cover 26, and then removing wood screws 54 together with track beam 24, with threaded sleeves 48, nuts 50, 51 and washer 58 being still firmly attached and correctly adjusted to back web 46. The wall surface can then be painted. Track 14 is reinstalled by holding beam 24 in place and reinstalling wood screws 54, then front cover 26 and end caps 30 with screws 28.

The subject invention accordingly provides a track system which allows wall hangings to be suspended and easily repositioned along the length of track 14 at various positions on wall 12 without damaging the wall surface with each repositioning. Track system 10 is further adapted to suspend wall hangings evenly on an irregular wall surface through the adjustment of connectors 16. Track system 10 also allows heavier wall hangings, such as flat screen television monitors and stereo equipment, to be suspended from track 14 regardless of the location of wall stud beams in the wall. Since suspending device 20 consists in part of a hock 21, track system 10 can be used in association with conventional wire hung wall hangings. Track 14 can also be easily removed and reinstalled for redecorating purposes without having to readjust connectors 16.

As will be apparent to persons skilled in the art, various modifications and adaptations of the structure described above are possible without departure from the present invention, the scope of which is defined in the appended claims.

I claim:

1. A track system for adjustably mounting wall hangings on a wall having an uneven wall surface, comprising:

(a) an elongated track dimensioned to extend horizontally along the wall;

(b) a plurality of longitudinally spaced connectors extendable between the track and the wall for rigidly coupling the track to the wall and aligning the track in a straight horizontal line laterally offset from the wall surface, each of the connectors being individually adjustable in length so as to compensate for local irregularities in the wall surface; and (c) at least one carriage shaped for engaging and sliding along the track, the carriage comprising a suspending device for suspending a wall hanging therefrom.

2. The track system defined in claim 1, wherein each of the connectors comprise a fastener releasably couplable to an adjuster, the fastener having one end shaped to securely engage the wall, and the adjuster being releasably couplable to the track.

3. The track system defined in claim 2, wherein the track comprises an elongated beam having a plurality of longitudinally spaced apertures sized to accommodate the adjusters.

4. The track system defined in claim 3, wherein the adjuster comprises a threaded sleeve having an outside surface shaped to fit within one of the apertures and a central bore sized to receive the fastener, and a pair of nuts shaped to engage the outer surface of the threaded sleeve, one nut being positioned adjacent to one side of the beam and the other nut being positioned adjacent to the other side of the beam, so as to grip the beam at an offset distance from the wall surface, and wherein the offset distance can be varied by adjusting the relative position of the nuts on the threaded sleeve.

5. The track system defined in claim 4, wherein the fastener comprises a screw having a threaded end dimensioned to extend through the bore of the threaded sleeve so as to securely engage the wall surface, and a head dimensioned to be larger than the bore, such that when the threaded end of the screw is securely engaged with the wall the head securely biases the threaded sleeve to the wall surface.

6. The track system defined in claim 5, wherein the connector further comprises a center point guide having a sleeve portion sized to fit within the bore of the threaded sleeve for centering the screw within the threaded sleeve, and a footing flange extending beyond the outside of the threaded sleeve for protecting the wall surface from incidental damage.

7. The track system defined in claim 3, wherein the beam comprises a track beam having a laterally extending top portion connected to a laterally extending bottom portion by a web.

8. The track system defined in claim 6, wherein the track further comprises a C-shaped track cover shaped to fit over the top portion and the bottom portion of the track beam so as to conceal the web.

9. The track system defined in claim 1, wherein each carriage comprises a C-shaped carriage body shaped to engage the track having a front surface provided with a finger grip extending outwardly therefrom and shaped to be gripped by a user, wherein the suspending device is coupled to the underside of the carriage body.

10. The track system defined in claim 9, wherein the carriage body further comprises a releasable clamp for releasably securing the carriage on the track, such that when no lateral pressure is applied to the finger grip, the clamp biases the carriage body against the track and when lateral pressure is applied to the finger grip, the clamp is released.

11. The track system defined in claim 10, wherein the suspending device comprises a hook and a hook position adjuster for adjusting the lateral position of the hook relative to the wall surface.

12. The track system defined in claim 11, wherein the hook position adjuster comprises a guide block rigidly coupled to the underside of the carriage body having a threaded lateral aperture and a lateral guide slot, a hook bracket extending upwardly from the hook having a lateral top portion shaped to fit within and slide along the guide slot, a casing shaped to accommodate the guide block and the hook bracket, and an adjusting screw sized to fit through the threaded lateral aperture and to cooperate with the hook bracket and casing to move the hook laterally against the wall surface.

13. The track system defined in claim 1, wherein the track and the carriage are formed of metal.

14. A track system for adjustably mounting wall hangings on a wall, comprising:

(a) an elongated track dimensioned to extend horizontally along the wall;

(b) a plurality of longitudinally spaced connectors extendable between the track and the wall for rigidly mounting the track on the wall; and (c) at least one carriage shaped for sliding along the track, the carriage comprising:

(i) a generally C-shaped carriage body shaped to slidingly engage the track, the carriage body having a finger grip on a front surface thereof for sliding the carriage along the track;

(ii) a releasable clamp for releasably biasing the carriage body against the track, the clamp being released when lateral pressure is applied to the finger grip; and (iii) a suspending device depending from and attached to the carriage body for suspending a wall hanging, comprising a hook shaped to receive a wire extending upwardly from the wall hanging.

15. The track system defined in claim 14, wherein the clamp comprises a pair of biasing arms and clamping legs, such that when no lateral pressure is applied to the finger grip, the biasing arms bias the clamping legs against the track and when lateral pressure is applied to the finger grip, the biasing arms release the clamping legs.

16. The track system defined in claim 14, wherein the suspending device comprises a hook position adjuster for adjusting the lateral position of the hook relative to the wall surface.

17. The track system defined in claim 15, wherein the finger grip is made of flexible rubber.

18. A track system for adjustably mounting wall hangings on a wall, comprising:

(a) an elongated track dimensioned to extend horizontally along the wall;

(b) a plurality of longitudinally spaced connectors extendable between the track and the wall for rigidly mounting the track on the wall;

(c) at least one carriage shaped for engaging and sliding along the track, the carriage comprising a generally C-shaped carriage body shaped to slidingly engage the track, and a suspending device depending from the carriage body for suspending a wall hanging, the suspending device comprising a hook and a hook position adjuster for adjusting the lateral position of the hook relative to the wall surface.

19. The track system defined in claim 18, wherein the hook position adjuster comprises a guide block rigidly coupled to the underside of the carriage body having a threaded lateral aperture and a lateral guide slot, a hook bracket extending upwardly from the hook having a lateral top portion shaped to fit within and slide along the guide slot, a casing shaped to cover the guide block and the hook bracket and an adjusting screw sized to fit through the threaded lateral aperture and to cooperate with the hook bracket and casing to move the hook laterally against the wall surface.

20. The track system defined in claim 19, wherein the adjustable screw has a securable end and the hook bracket comprises front plate coupled to the front end of the lateral top portion and a back plate coupled to the back end of the lateral top portion, the front plate having an aperture sized to receive the adjusting screw and the back plate having a smaller aperture sized to accommodate and secure the end of the adjusting screw so as to allow the lateral position of the hook to be adjusted towards and away from the wall surface.

21. The track system defined in claim 20, wherein the adjusting screw has a threaded body and the securable end of the adjusting screw has a smaller diameter than the diameter of the threaded body of the adjusting screw and is secured to the back plate by a snap ring.

* * * * *